US009898961B2

(12) United States Patent
Jeong et al.

(10) Patent No.: US 9,898,961 B2
(45) Date of Patent: Feb. 20, 2018

(54) DATA PROCESSING METHOD AND APPARATUS FOR ORGANIC LIGHT EMITTING DIODE DISPLAY DEVICE

(71) Applicant: LG Display Co., Ltd., Seoul (KR)

(72) Inventors: Ui-Taek Jeong, Gyeonggi-do (KR); Tae-Gung Kim, Gyeonggi-do (KR); Jung-Hyeon Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 16 days.

(21) Appl. No.: 14/551,289

(22) Filed: Nov. 24, 2014

(65) Prior Publication Data

US 2015/0187259 A1 Jul. 2, 2015

(30) Foreign Application Priority Data

Dec. 27, 2013 (KR) ..... 10-2013-0165358

(51) Int. Cl.
*G09G 5/00* (2006.01)
*G09G 3/3233* (2016.01)

(52) U.S. Cl.
CPC ..... *G09G 3/3233* (2013.01); *G09G 2300/043* (2013.01); *G09G 2300/0842* (2013.01); (Continued)

(58) Field of Classification Search
CPC ..... G09G 3/22; G09G 3/3208; G09G 3/30; G09G 3/3225; G09G 3/3233; G09G 3/3241; G09G 3/3266
See application file for complete search history.

(56) References Cited

U.S. PATENT DOCUMENTS 8,589,100 B2 * 11/2013 Chaji et al. ..... 702/64
2009/0135304 A1 * 5/2009 Inoue et al. ..... 348/712
(Continued)

FOREIGN PATENT DOCUMENTS

CN 101923828 A 12/2010
CN 103165076 A 6/2013

OTHER PUBLICATIONS

Office Action issued in corresponding Chinese Patent Application No. 201410788233.2 dated Sep. 5, 2016.

*Primary Examiner* — Kent Chang
*Assistant Examiner* — William Lu
(74) *Attorney, Agent, or Firm* — Morgan, Lewis & Bockius LLP

(57) ABSTRACT

A data processing method and an apparatus for an organic light emitting diode (OLED) display device are provided. The method includes modulating input data using a maximum degradation compensation gain, compensating degradation of the modulated data using a degradation compensation gain, accumulating the degradation-compensated data, determining a degree of degradation of each of sub-pixels, based on the accumulated data, detecting a degradation compensation gain in accordance with the determined degradation degree, storing the detected degradation compensation gain, and outputting the stored degradation compensation gain, detecting a maximum one of degradation compensation gains of respective sub-pixels, and outputting the detected maximum degradation compensation gain, analyzing the input data, thereby setting a peak luminance control (PLC) gain, and modulating the PLC gain, using the output maximum degradation compensation gain, and analyzing the degradation-compensated data, thereby detecting a peak luminance, and adjusting the detected peak luminance, using the modulated PLC gain.

18 Claims, 8 Drawing Sheets

(52) U.S. Cl.
CPC ..... *G09G 2310/0251* (2013.01); *G09G 2310/0262* (2013.01); *G09G 2320/0295* (2013.01); *G09G 2320/048* (2013.01); *G09G 2320/0673* (2013.01); *G09G 2360/16* (2013.01)

(56) References Cited

U.S. PATENT DOCUMENTS

| | | | | |
|---|---|---|---|---|
| 2009/0167644 | A1* | 7/2009 | White et al. | 345/76 |
| 2010/0315449 | A1* | 12/2010 | Chaji et al. | 345/690 |
| 2011/0058237 | A1* | 3/2011 | Mikami | H04N 1/40056 358/509 |
| 2011/0199395 | A1* | 8/2011 | Nathan et al. | 345/690 |
| 2012/0306947 | A1* | 12/2012 | Kim | G09G 3/3233 345/694 |
| 2013/0088482 | A1* | 4/2013 | Nathan et al. | 345/212 |
| 2013/0147693 | A1* | 6/2013 | Bae | G09G 3/3208 345/82 |
| 2013/0265338 | A1 | 10/2013 | Chaji et al. | |
| 2013/0322753 | A1* | 12/2013 | Lim | G06T 5/001 382/167 |
| 2014/0111567 | A1* | 4/2014 | Nathan et al. | 345/694 |

* cited by examiner

DATA PROCESSING METHOD AND APPARATUS FOR ORGANIC LIGHT EMITTING DIODE DISPLAY DEVICE

This application claims the benefit of Korean Patent Application No. 10-2013-0165358, filed on Dec. 27, 2013, which is hereby incorporated by reference as if fully set forth herein.

BACKGROUND OF THE INVENTION

Field of the Invention

The present invention relates to an organic light emitting diode (OLED) display device, and more particularly to a data processing method and apparatus for an OLED display device, which are capable of adaptively controlling a peak luminance in accordance with compensation for degradation, thereby securing a sufficient compensation margin.

Discussion of the Related Art

An organic light emitting diode (OLED) display device is a self-luminous device in which an organic light emitting layer emits light through re-combination of electrons and holes. Since the OLED display device exhibits high luminance, and uses a low drive voltage while having an ultra-slim structure, the OLED display device is expected to be a next-generation display device.

Such an OLED display device includes a plurality of pixels, each of which includes an OLED constituted by an anode, a cathode, and an organic light emitting layer interposed between the anode and the cathode, and a pixel circuit for independently driving the OLED. The pixel circuit includes at least a switching transistor, a storage capacitor, and a drive transistor. The switching transistor charges the storage capacitor with a voltage corresponding to a data signal in response to a scan pulse. The drive transistor controls the amount of current supplied to the OLED in accordance with the level of the voltage charged in the storage capacitor, to adjust the amount of light emitted from the OLED. The amount of light emitted from the OLED is proportional to the amount of current supplied from the drive transistor to the OLED.

In order to reduce consumption of electric power, related art OLED display devices use a method for controlling current supplied to a display panel by controlling a peak luminance (maximum white luminance) in accordance with an input image. As shown in FIG. 1, such a related art OLED display device controls a peak luminance, using a peak luminance control (PLC) gain determined in accordance with an average picture level (APL) of each frame. For example, the related art OLED display device achieves reduction of power consumption by decreasing the peak luminance to 100 nit, using a PLC gain of 1, when APL is as high as 100%, and increasing the peak luminance to 500 nit, using a PLC gain of 4, when APL is as low as 25%.

OLED display devices have a problem in that OLEDs are non-linearly degraded with passage of time due to electrical stress, thereby exhibiting a luminance deviation for the same data and, as such, a latent image is generated.

In order to solve this problem, OLED display devices use a degradation compensation method for achieving an increase in luminance by estimating a degree of degradation, based on accumulated data, and compensating data, based on the estimated degradation degree, as shown in FIG. 2.

However, such a related art degradation compensation method has a problem in that, although degradation compensation is possible in low and middle grayscale regions provided with a sufficient compensation margin, such degradation compensation is impossible in high grayscale regions provided with an insufficient compensation margin.

Meanwhile, when a maximum gamma voltage is first increased to secure a desired compensation margin, there are problems in that consumption of electric power is increased, and grayscale rendering capability is degraded, thereby causing degradation of picture quality.

SUMMARY OF THE INVENTION

Accordingly, the present invention is directed to a data processing method and apparatus for an organic light emitting diode (OLED) display device that substantially obviate one or more problems due to limitations and disadvantages of the related art.

An object of the present invention is to provide a data processing method and apparatus for an OLED display device, which are capable of adaptively controlling a peak luminance in accordance with compensation for degradation, thereby securing a sufficient compensation margin even in a high grayscale region.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a data processing method of an organic light emitting diode display device includes the steps of (A) modulating input data, using a maximum degradation compensation gain, compensating degradation of the modulated data, using a degradation compensation gain, (C) accumulating the degradation-compensated data, determining a degree of degradation of each of sub-pixels, based on the accumulated data, detecting a degradation compensation gain in accordance with the determined degradation degree, storing the detected degradation compensation gain, and outputting the stored degradation compensation gain, (D) detecting a maximum one of degradation compensation gains of respective sub-pixels, and outputting the detected maximum degradation compensation gain, (E) analyzing the input data, thereby setting a peak luminance control (PLC) gain, and modulating the PLC gain, using the output maximum degradation compensation gain, and (F) analyzing the degradation-compensated data, thereby detecting a peak luminance, and adjusting the detected peak luminance, using the modulated PLC gain.

In another aspect, a data processing apparatus of an organic light emitting diode display device includes a data modulator for modulating input data, using a maximum degradation compensation gain, a data compensator for compensating degradation of the modulated data, using a degradation compensation gain, a degradation compensation gain detector for accumulating the degradation-compensated data, determining a degree of degradation of each of sub-pixels, based on the accumulated data, detecting a degradation compensation gain in accordance with the determined degradation degree, storing the detected degradation compensation gain, and outputting the stored degradation compensation gain, a maximum gain detector for detecting a maximum one of degradation compensation gains of respective sub-pixels, and outputting the detected maximum degradation compensation gain, a PLC gain setter for analyzing the input data, thereby setting a PLC gain, and modulating the PLC gain, using the output maximum degradation compensation gain, and a PLC calculator for analyzing the degradation-compensated data, thereby detecting a peak luminance, and adjusting the detected peak luminance, using the modulated PLC gain.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and along with the description serve to explain the principle of the invention. In the drawings.

DETAILED DESCRIPTION OF THE ILLUSTRATED EMBODIMENTS

Reference will now be made in detail to the preferred embodiments of the present invention, examples of which are illustrated in the accompanying drawings.

Figure 1:
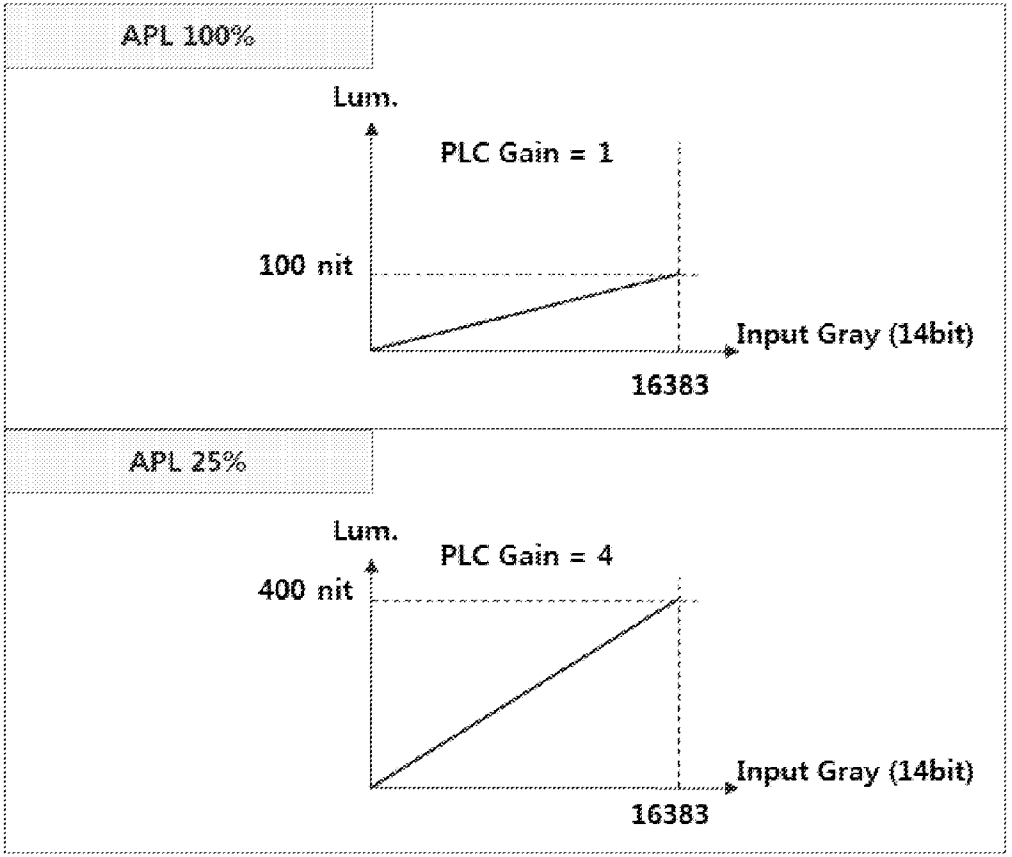
FIG. 1 is a graph explaining a peak luminance control method of a related art organic light emitting diode (OLED) display device.
Figure 2:
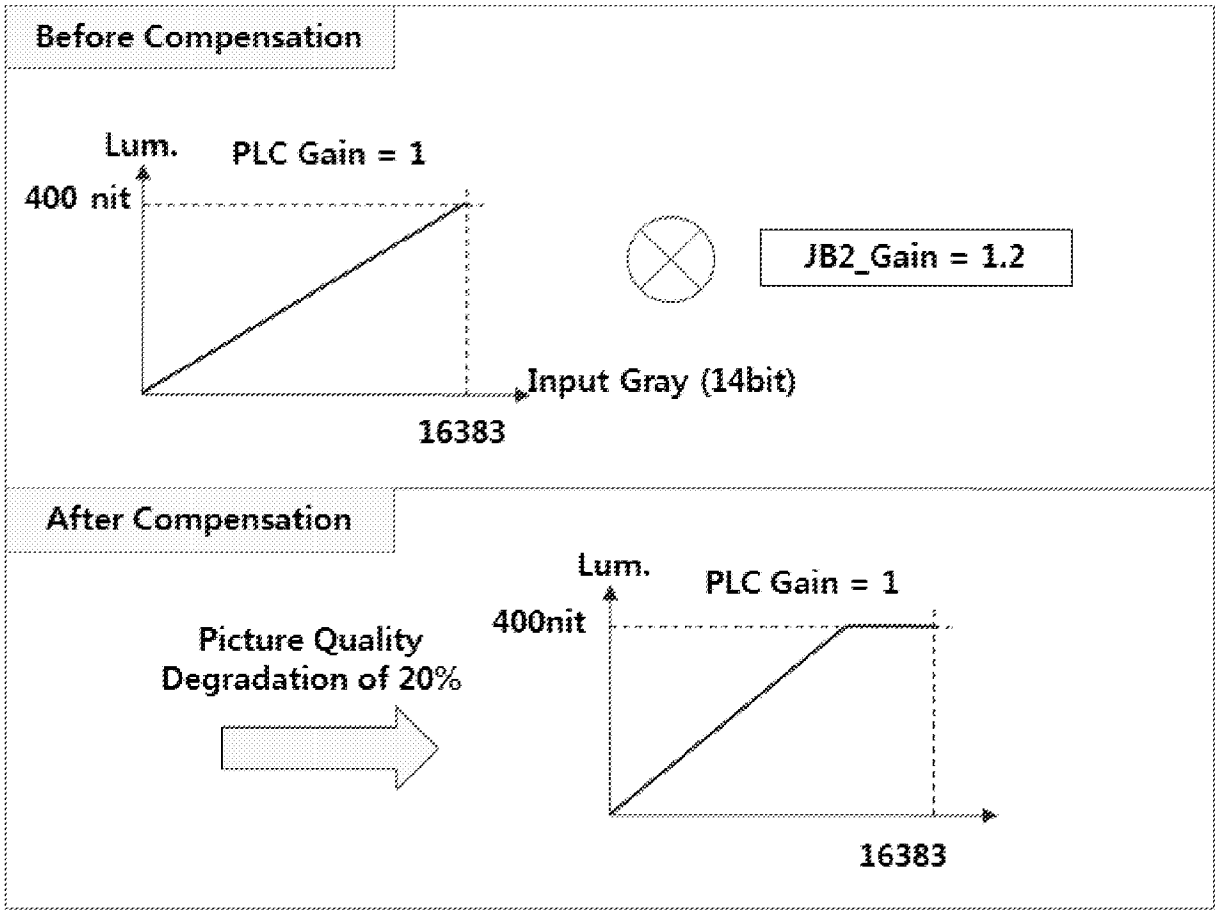
FIG. 2 is a graph depicting results of a comparison of luminance variations depending on grayscale values before and after degradation compensation in the related art OLED display device.
Figure 3:
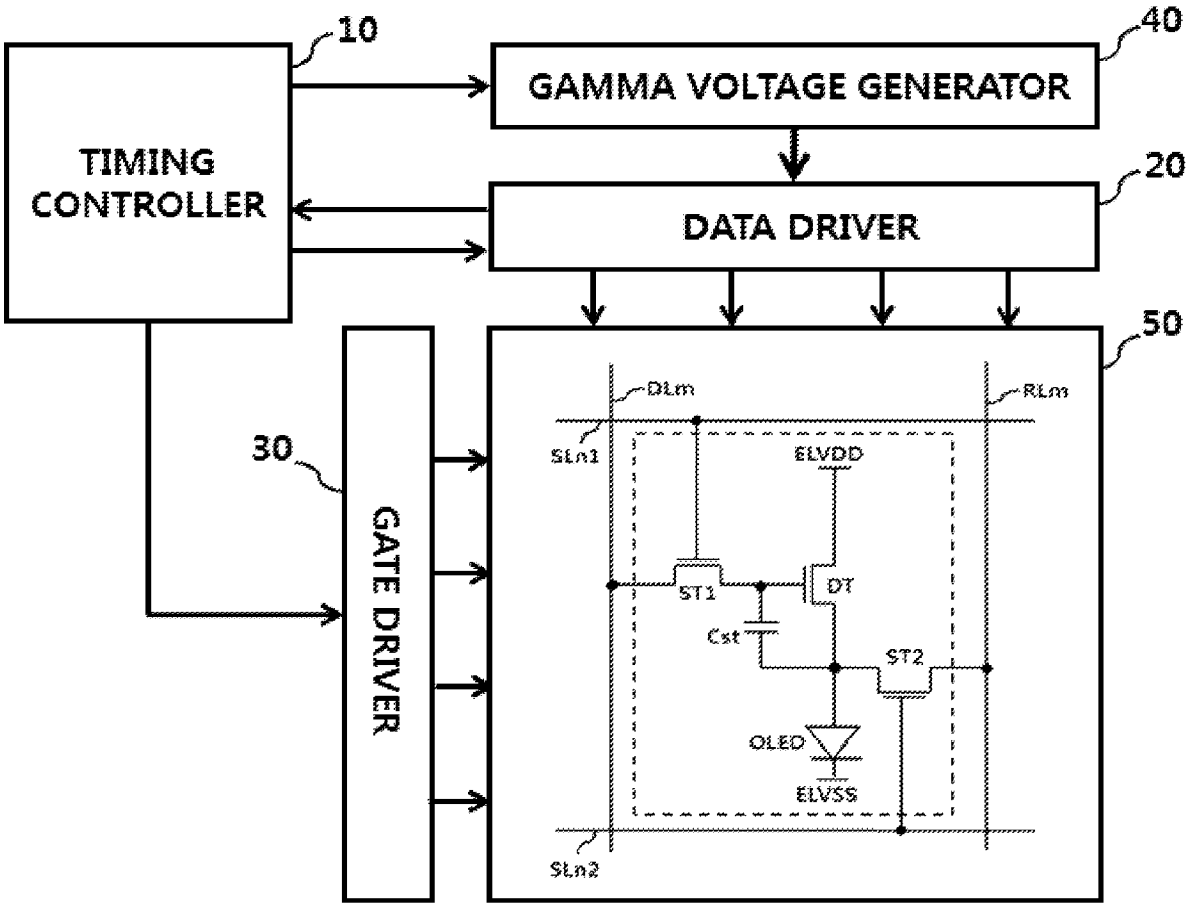
FIG. 3 is a block diagram illustrating an OLED display device according to an embodiment of the present invention is applied.

FIG. 3 is a block diagram illustrating an organic light emitting diode (OLED) display device, to which a peak luminance controller according to an embodiment of the present invention is applied.

The OLED display device illustrated in FIG. 3 includes a timing controller 10, a data driver 20, a gate driver 30, a gamma voltage generator 40, and a display panel 50.

The timing controller 10 generates a data control signal and a gate control signal to control respective drive timings of the data driver 20 and gate driver 30, based on a plurality of synchronization signals input from the outside of the display device, and outputs the data control signal and gate control signal to the data driver 20 and gate driver 30, respectively.

The timing controller 10 may modulate an input image through various data modulation methods for improvement of picture quality and reduction of power consumption.

The timing controller 10 estimates a degree of degradation of each sub-pixel, based on accumulated data, detects a degradation compensation gain for compensation for degradation of the sub-pixel, based on the estimated degradation degree, stores the detected degradation compensation gain, and compensates input data, using the stored compensation gain.

In particular, the timing controller 10 modulates input data, using a maximum one of degradation compensation gains obtained for respective sub-pixels before degradation compensation of data.

In addition, the timing controller 10 analyzes input data, to set a peak luminance control (PLC) gain in accordance with image characteristics such as an average picture level (APL). Using the PLC gain, the timing controller 10 adjusts a peak luminance. In this case, the timing controller 10 modulates the PLC gain, using a maximum degradation compensation gain. Using the modulated PLC gain, the timing controller 10 then adjusts a peak luminance. In accordance with a peak luminance control method of the timing controller 10, data, for which degradation compensation has been completed, is analyzed, to detect a peak luminance. The peak luminance is then adjusted, using a modulated PLC gain. The adjusted peak luminance is converted into a maximum gamma voltage, which is, in turn, supplied to the gamma voltage generator 40.

The input data and PLC gain are not modulated because the degradation compensation gain in an initial driving period, in which no degradation is progressed, is 1.

The timing controller 10 senses information including characteristics of a drive thin film transistor (TFT) DT of each sub-pixel, namely, a threshold voltage Vth and a mobility, using the data driver 20. The timing controller 10 compares the sensed information (sensing data) with predetermined reference information, to detect compensation information. The timing controller 10 stores the detected compensation information. Prior to the degradation compensation, the timing controller 10 may compensate the modulated data, using the compensation information. Otherwise, after the degradation compensation, the timing controller 10 may compensate degradation-compensated data, using the compensation information. Thus, the timing controller 10 may compensate for a characteristic deviation of the drive TFT of each sub-pixel.

The gamma voltage generator 40 generates a gamma voltage set including a plurality of gamma voltages having different levels, and supplies the generated gamma voltage st to the data driver 20. The gamma voltage generator 40 divides a maximum gamma voltage supplied from the timing controller 100, using a resistor string, thereby generating and outputting a gamma voltage set including a plurality of gamma voltages. The gamma voltage generator 40 may use a programmable gamma. The gamma voltage generator 40 may be built in the data driver 20.

The data driver 20 converts digital data from the timing controller 10 into an analog data signal, in response to a data control signal from the timing controller 10, and supplies the converted analog data signal to a plurality of data lines included in the display panel 50. In this case, the data driver 20 sub-divides the gamma voltage set from the gamma voltage generator 40 into grayscale voltages corresponding to respective grayscale values of data, and converts digital data into an analog data signal, using the sub-divided grayscale voltages. The data driver 20 is driven in a sensing mode for external compensation and a display mode for display driving under the control of the timing controller 10. In the display mode, the data driver 20 drives each sub-pixel through a corresponding one of the data lines, using the data signal. In the sensing mode, the data driver 20 drives each sub-pixel, using a pre-charge voltage, and senses a sensing voltage or sensing current from each driven sub-pixel through a sensing channel (data line or reference line), converts the sensed sensing voltage or sensing current into sensing data, and then sends the sensing data to the timing controller 10.

The data driver 20 may be constituted by at least one data drive integrated circuit (IC). In this case, the data driver 20 may be mounted on a circuit film such as a tape carrier package (TCP), a chip on film (COF), or a flexible printed circuit (FPC). The resultant structure is attached to the display panel 50 using tape automatic bonding (TAB). Alternatively, the structure may be mounted on a non-display area of the display panel 50 in a chip on glass manner.

The gate driver 30 sequentially drives a plurality of gate lines included in the display panel 50 in response to a gate control signal from the timing controller 10. The gate driver 30 supplies a gate-on voltage in a scan period corresponding to each gate line in response to the gate control signal. In a period other than the scan period, the gate driver 30 supplies a gate-off signal. The gate driver 30 may directly receive the gate control signal from the timing controller 10. Otherwise, the gate driver 30 may receive the gate control signal via the data driver 20.

The gate driver 30 may be constituted by at least one gate drive IC. In this case, the gate driver 30 may be mounted on a TCP, a COF, or an FPC. The resultant structure may be attached to the display panel 50 in a TAB manner or may be mounted on a non-display area of the display panel 50. Alternatively, the gate driver 30 may be formed on a non-display area of a TFT substrate, along with a TFT array formed at a pixel array of the display panel 50 and, as such, may be formed in the form of a gate in panel structure built in the display panel 50.

The display panel 50 includes a pixel array having the form of a matrix. Each pixel of the pixel array has a combination of red (R), green (G), and blue (B) sub-pixels, to render a desired color. Each pixel of the pixel array may further include a white (W) sub-pixel for enhancement of luminance.

Each sub-pixel includes an OLED, and a pixel circuit to drive the OLED. The pixel circuit may include first and second switching TFTs ST1 and ST2, a drive TFT DT, and a storage capacitor Cst. The pixel circuit further is connected to first and second gate lines GLn1 and GLn2 to control first and second switching TFTs ST1 and ST2, respectively, a data line DLm to supply a data signal to the first switching TFT ST1, a reference line RLm to supply a reference voltage Vref to the second switching TFT ST2, an ELVDD line to supply a high-level supply voltage ELVDD to the drive TFT DT, and an ELVSS line to supply a low-level supply voltage ELVSS to a cathode of the OLED.

The OLED is connected in series to the drive TFT DT between the ELVDD line and the ELVSS line. In addition to the cathode, which is connected to the ELVSS line, the OLED includes an anode connected to the drive TFT DT, and a light emitting layer arranged between the anode and the cathode. The light emitting layer includes an electron injection layer, an electron transport layer, an organic light emitting layer, a hole transport layer, and a hole injection layer. In the OLED, electrons from the cathode are supplied to the organic light emitting layer via the electron injection layer and electron transport layer when a positive bias is applied between the anode and the cathode. At the same time, holes from the anode are supplied to the organic light emitting layer via the hole injection layer and hole transport layer. As a result, the electrons and holes supplied to the organic light emitting layer are re-combined and, as such, a fluorescent or phosphorescent material emits light. Thus, light is generated in proportion to an amount of current supplied.

The first switching TFT ST1 charges the storage capacitor Cst with a voltage corresponding to a data signal from the data line DL in response to a control signal from the first gate line GLn1. In this case, the second switching TFT ST2 supplies a reference voltage Vref from the reference line RLm in response to a control signal from the second gate line GLn2. The drive TFT DT controls an amount of current supplied to the OLED in accordance with a voltage charged in the storage capacitor Cst and, as such, adjusts an amount of light emitted from the OLED. Meanwhile, the second switching TFT ST2 may be used as a path to supply, to the reference line RLm, a pixel current output in accordance with drive characteristics of the pixel circuit in the sensing mode.

Figure 4:
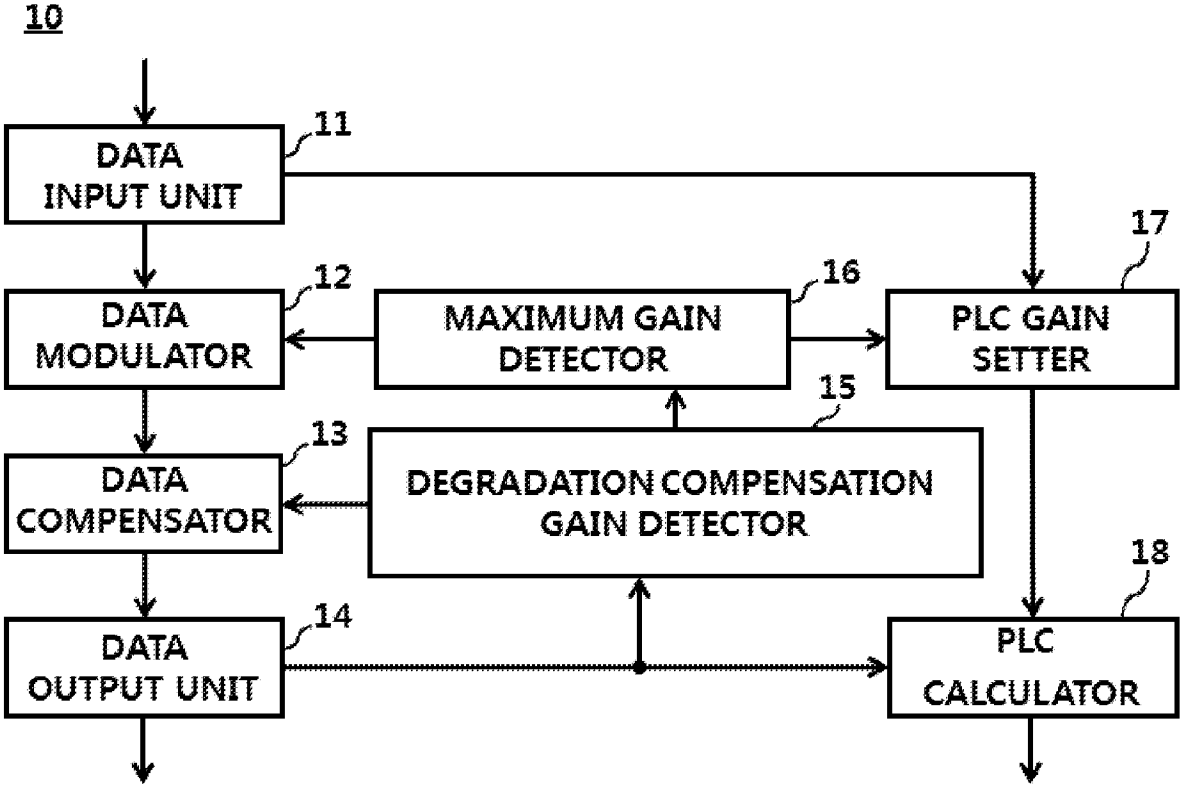
FIG. 4 is a block diagram illustrating a configuration of a data processor included in a timing controller illustrated in FIG. 3.
Figure 5:
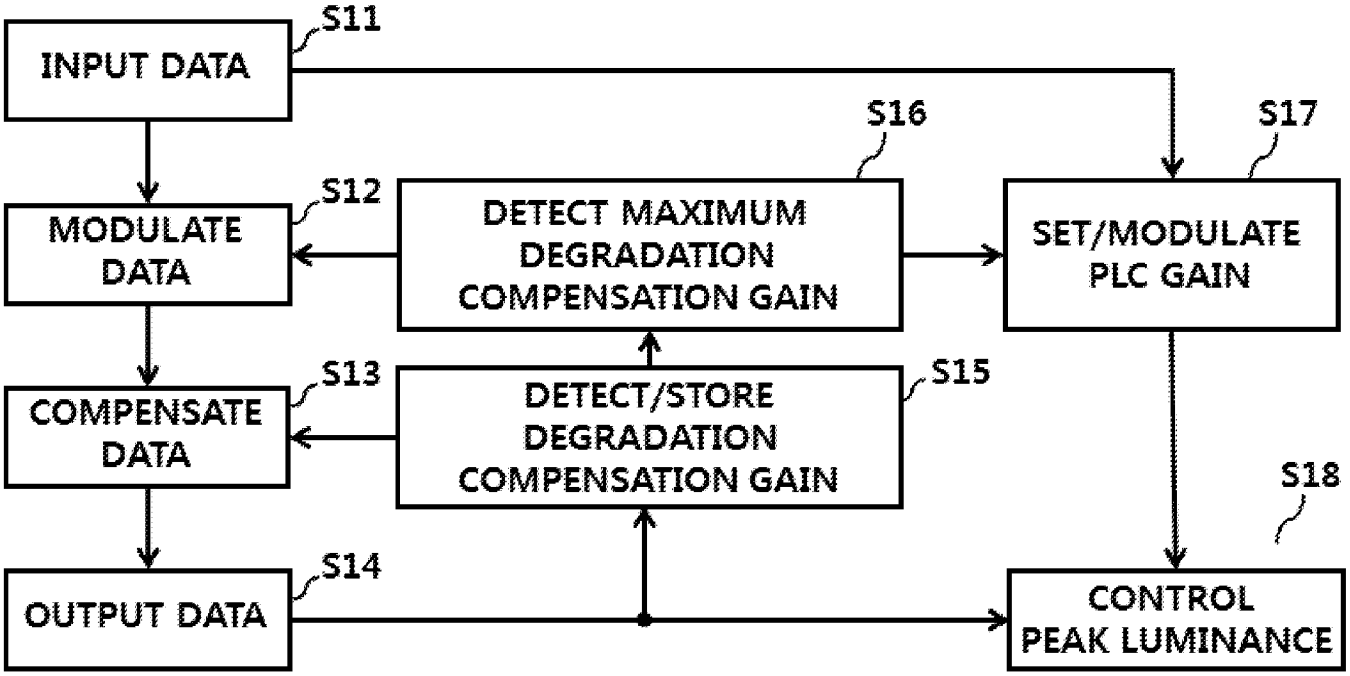
FIG. 5 is a flowchart illustrating sequential steps of a data processing method executed in the data processor illustrated in FIG. 4.

FIG. 4 is a block diagram illustrating an inner configuration of a data processor built in the timing controller illustrated in FIG. 3. FIG. 5 is a flowchart illustrating sequential steps of a data processing method executed in the data processor illustrated in FIG. 4.

As illustrated in FIG. 4, the data process of the timing controller 10 includes a data input unit 11, a data modulator 12, a data compensator 13, a data output unit 14, a degradation compensation gain detector 15, a maximum gain detector 16, a PLC gain setter 17, and a PLC calculator 18.

Referring to FIGS. 4 and 5, the data input unit 11 receives data input from the outside of the display device, and outputs the received data to the data modulator 12 and PLC gain setter 17 (S11).

The data modulator 12 modulates the received data, using a maximum degradation compensation gain supplied from the maximum gain detector 16, and outputs the modulated data (S12). The data modulator 12 may modulate the data to reduce the data in accordance with the maximum degradation compensation gain, and outputs the reduced data.

The data compensator 13 compensates the modulated data output from the data modulator 12, using a degradation compensation gain supplied from the degradation compensation gain detector 15, and outputs the compensated data (S13). The data compensator 13 may compensate for degradation of the modulated data by multiplying the modulated data by the degradation compensation gain.

In addition, the data compensator 13 may first compensate data output from the data modulator 12, using compensation information for compensation of characteristics of the drive TFT included in each sub-pixel, before degradation compensation, and may then execute degradation compensation, using the degradation compensation gain. Alternatively, the data compensator 13 may compensate characteristic deviation of the drive TFT included in each sub-pixel by compensating degradation-compensated data, using the compensation information.

The data output unit 14 outputs data output from the data compensator 13 to the compensation gain detector 15 and PLC calculator 18 while outputting the data to the data driver 20 (S14).

The degradation compensation gain detector 15 accumulates output data supplied from the data output unit 14, to determine a degree of degradation of each sub-pixel. The degradation compensation gain detector 15 then sets degradation compensation gains according to degrees of degradation determined for respective sub-pixels, and stores the set degradation compensation gains. The degradation compensation gain detector 15 subsequently outputs the stored degradation compensation gains to the data compensator 13 and maximum gain detector 16 (S15).

The maximum gain detector 16 compares the pixel-based degradation compensation gains stored in the degradation compensation gain detector 15 with one another, to detect a maximum degradation compensation gain. The maximum gain detector 16 then outputs the maximum degradation compensation gain to the data compensator 12 and PLC gain setter 17 (S16).

The PLC gain setter 17 analyzes data output from the data input unit 11, to set a PLC gain according to image characteristics. The PLC gain setter 17 then modulates the PLC gain, using the maximum degradation compensation gain output from the maximum gain detector 16. The PLC gain setter 17 subsequently outputs the modulated PLC gain to the PLC calculator 18 (S17). The PLC gain setter 17 may correct a PLC gain, using recognition characteristic information such as edge information or histogram distribution information. The PLC gain setter 17 may modulate the PLC gain by multiplying the PLC gain by the maximum degradation compensation gain.

The PLC calculator 18 detects a peak luminance by analyzing data output from the data output unit 14. The PLC calculator 18 then adjusts the detected peak luminance, using the modulated PLC gain supplied form the PLC gain setter 17. The PLC calculator 18 subsequently converts the adjusted peak luminance into a maximum gamma voltage, and outputs the maximum gamma voltage to the gamma voltage generator 40 (S18).

In an initial driving period, in which no degradation is progressed, the input data and PLC gain are not modulated because the degradation compensation gain is 1.

Figure 6:
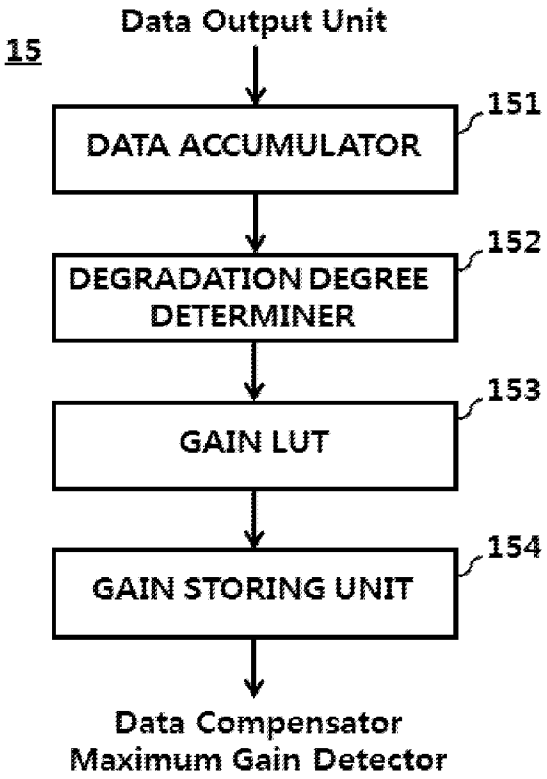
FIG. 6 is a block diagram illustrating an inner configuration of the degradation compensation gain detector illustrated in FIG. 4.

FIG. 6 is a block diagram illustrating an inner configuration of the degradation compensation gain detector illustrated in FIG. 4.

As illustrated in FIG. 6, the degradation compensation gain detector 15 includes a data accumulator 151, a degradation degree determiner 152, a gain look-up table (LUT) 153, and a gain storing unit 154.

The data accumulator 151 accumulates output data supplied from the data output unit 14 illustrated in FIG. 4, and outputs accumulated data for each sub-pixel.

The degradation degree determiner 152 determines a degree of degradation of each sub-pixel, using the accumulated data supplied from the data accumulator 151, and outputs the determined degradation degree data.

The gain LUT 153 selects a degradation compensation gain for each sub-pixel, using the corresponding degradation degree data supplied form the degradation degree determiner 152. To this end, degradation compensation gains according to respective degradation degree data have been previously set and stored in the form of an LUT.

The gain storing unit 154 stores a degradation compensation gain for each sub-pixel supplied from the gain LUT 153, and supplies the degradation compensation gain to the data compensator 13 and maximum gain detector 16 illustrated in FIG. 4. The gain storing unit 154 may be implemented, using a frame memory to store degradation compensation gains of respective sub-pixels.

Figure 7:
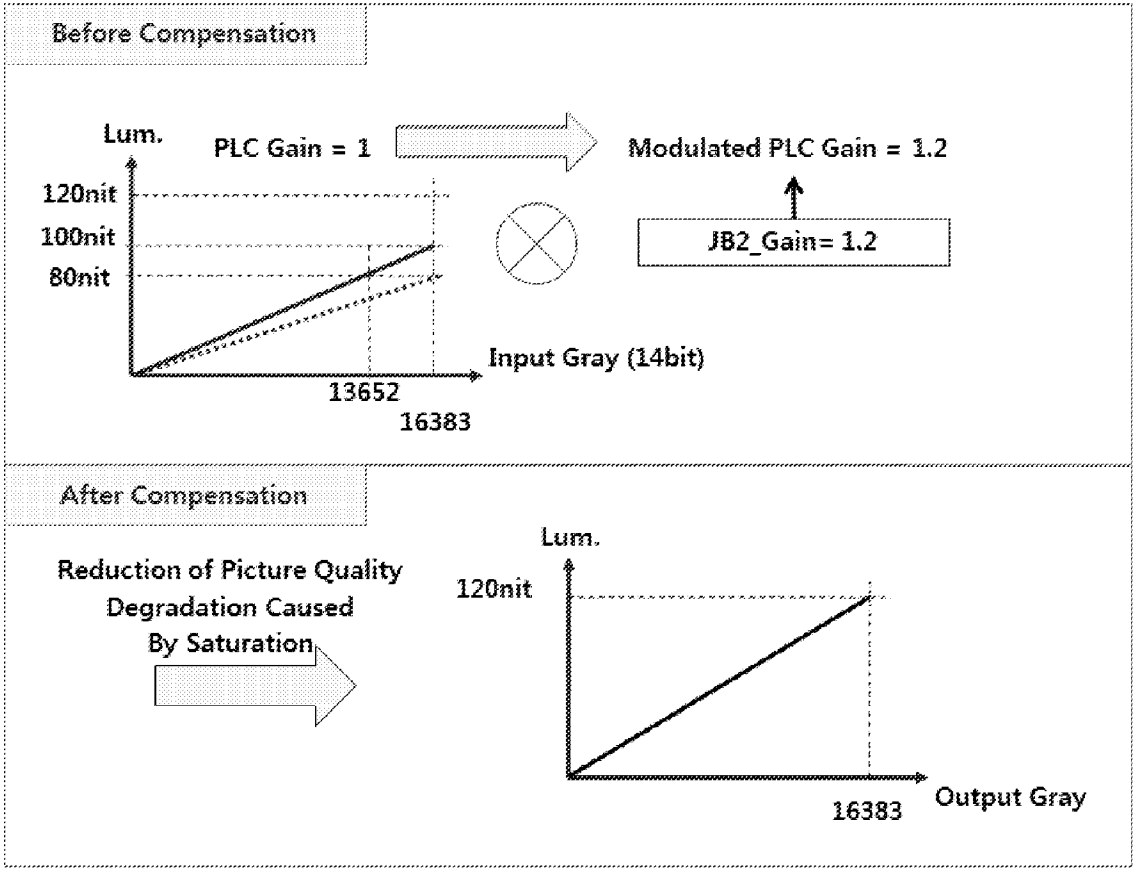
FIG. 7 is a concept diagram illustrating securing of a degradation compensation margin in the OLED display device according to an embodiment of the present invention.

FIG. 7 is a concept diagram illustrating securing of a degradation compensation margin in the OLED display device according to an embodiment of the present invention.

Referring to FIG. 7, in a period before degradation is progressed in the OLED display device, a PLC gain set to 1 and a peak luminance set to 100 nit are used. When an OLED is degraded with passage of driving time, the peak luminance may be reduced to 80 nit. However, it may be seen that it may be possible to saturate the peak luminance without being degraded in high grayscale regions by modulating data while modulating the PLC gain to 1.2, using a maximum degradation compensation gain (JB_2=1.2), thereby securing a desired degradation compensation margin and, as such, the peak luminance may be increased to 120 nit. Thus, although an OLED is degraded, it may be possible to achieve degradation compensation to obtain a luminance similar to a luminance in an initial driving period. It may also be possible to adaptively secure a desired degradation compensation margin with passage of time.

Figure 8:
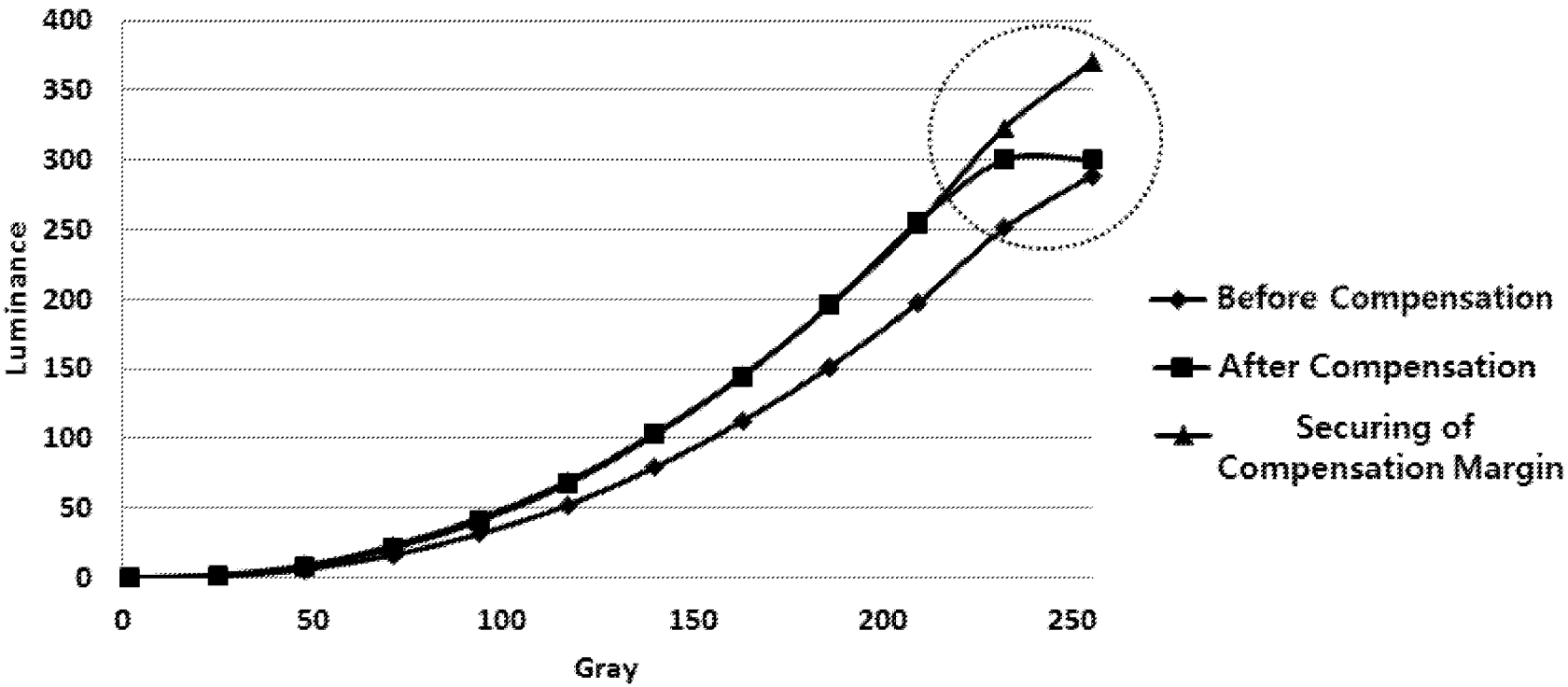
FIG. 8 is a graph depicting results of a comparison of luminance variations depending on grayscale values before and after degradation compensation in the OLED display device according to the illustrated embodiment of the present invention with those of a related art case.

FIG. 8 is a graph depicting results of a comparison of luminance variations depending on grayscale values before and after degradation compensation in the OLED display device according to the illustrated embodiment of the present invention with those of a related art case.

Referring to FIG. 8, the related art OLED display device has a problem in that a compensation margin for degradation compensation is saturated in high grayscale regions, that is, no desired compensation margin is secured, and, as such, degradation compensation is impossible. In the OLED display device according to the illustrated embodiment of the present invention, it may be possible to secure a desired degradation compensation margin even in high grayscale regions by modulating the input data and PLC gain by a maximum degradation compensation gain upon degradation compensation and, as such, degradation compensation is possible.

As described above, the OLED display device according to the present invention controls the peak luminance by modulating the input data and PLC gain, using the maximum degradation compensation gain before degradation of the input data is compensated for, using a degradation compensation gain according to accumulated data.

Accordingly, in the OLED display device according to the present invention, no additional compensation margin is secured until degradation is progressed and, as such, it may be possible to reduce consumption of electric power, as compared to the case in which a desired compensation margin is initially secured. When degradation is progressed, a desired compensation margin is secured, to execute degradation compensation without reduction of luminance. As a result, an improvement in picture quality may be achieved.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A data processing method of an organic light emitting diode display device, comprising:

(A) modulating uncompensated input image data using a maximum degradation compensation gain to produce modulated image data;

(B) compensating degradation of the modulated image data using a degradation compensation gain to produce degradation-compensated image data;

(C) accumulating the degradation-compensated image data per each of sub-pixels, determining a degree of degradation of each of the sub-pixels based on the accumulated image data per each of the sub-pixels, detecting a degradation compensation gain in accordance with the determined degradation degree, storing the detected degradation compensation gain, and outputting the stored degradation compensation gain;

(D) detecting a maximum one of degradation compensation gains of respective sub-pixels by comparing the stored detected degradation compensation gains of the respective sub-pixels with one another, and outputting the detected maximum degradation compensation gain;

(E) analyzing the uncompensated input image data, thereby setting a peak luminance control (PLC) gain, and modulating the PLC gain, using the output maximum degradation compensation gain; and (F) analyzing the degradation-compensated data, thereby detecting a peak luminance, and adjusting the detected peak luminance, using the modulated PLC gain.

2. The data processing method according to claim 1, wherein the step (C) comprises:

accumulating the degradation-compensated image data, thereby outputting the accumulated image data of respective sub-pixels;

determining a degree of degradation of each sub-pixel, using the accumulated image data of the sub-pixel;

selecting a degradation compensation gain of the sub-pixel corresponding to the determined degradation degree, and outputting the selected degradation compensation gain; and storing the output degradation compensation gain of the sub-pixel, and outputting the stored degradation compensation gain.

3. The data processing method according to claim 1, further comprising:

compensating the modulated image data, using compensation information detected in accordance with information obtained through sensing of drive characteristics of respective sub-pixels, before the degradation compensation; or compensating the modulated image data, using the compensation information, after the degradation compensation.

4. The data processing method according to claim 1, further comprising:

converting the adjusted peak luminance into a maximum gamma voltage to output the maximum gamma voltage to a gamma voltage generator.

5. The data processing method according to claim 1, wherein, in an initial driving period, in which no degradation is progressed, the input image data and PLC gain are not modulated because the degradation compensation gains of respective sub-pixels is 1.

6. The data processing method according to claim 1, wherein the input image data is reduced by the maximum degradation compensation gain.

7. The data processing method according to claim 1, wherein the peak luminance is adjusted by modulating the uncompensated input image data and the PLC gain before the compensation of the degradation of the modulated image data.

8. The data processing method according to claim 1, further comprising:

supplying the degradation-compensated image data to a data driver for display by the display device.

9. A data processing apparatus of an organic light emitting diode display device comprising:

a data modulator for modulating uncompensated input image data, using a maximum degradation compensation gain, to produce modulated image data;

a data compensator for compensating degradation of the modulated image data, using a degradation compensation gain, to produce degradation-compensated image data;

a degradation compensation gain detector for accumulating the degradation-compensated image data per each of sub-pixels, determining a degree of degradation of each of the sub-pixels, based on the accumulated image data per each of the sub-pixels, detecting a degradation compensation gain in accordance with the determined degradation degree, storing the detected degradation compensation gain, and outputting the stored degradation compensation gain;

a maximum gain detector for detecting a maximum one of degradation compensation gains of respective sub-pixels by comparing the stored detected degradation compensation gains of the respective sub-pixels with one another, and outputting the detected maximum degradation compensation gain;

a peak luminance control (PLC) gain setter for analyzing the uncompensated input image data, thereby setting a PLC gain, and modulating the PLC gain, using the output maximum degradation compensation gain; and a PLC calculator for analyzing the degradation-compensated image data, thereby detecting a peak luminance, and adjusting the detected peak luminance, using the modulated PLC gain.

10. The data processing apparatus according to claim 9, wherein the degradation compensation gain detector comprises:

a data accumulator for accumulating the degradation-compensated image data, thereby outputting the accumulated image data of respective sub-pixels;

a degradation degree determiner for determining a degree of degradation of each sub-pixel, using the accumulated image data of the sub-pixel;

a gain look-up table for selecting a degradation compensation gain of the sub-pixel corresponding to the determined degradation degree, and outputting the selected degradation compensation gain; and a gain storing unit for storing the output degradation compensation gain of the sub-pixel, and outputting the stored degradation compensation gain.

11. The data processing apparatus according to claim 9, wherein:

the data compensator compensates the modulated image data, using compensation information detected in accordance with information obtained through sensing of drive characteristics of respective sub-pixels, before the degradation compensation; or the data compensator compensates the modulated image data, using the compensation information, after the degradation compensation.

12. The data processing apparatus according to claim 9, wherein the PLC calculator converts the adjusted peak luminance into a maximum gamma voltage to output the maximum gamma voltage to a gamma voltage generator.

13. The data processing apparatus according to claim 9, wherein, in an initial driving period, in which no degradation is progressed, the uncompensated input image data and PLC gain are not modulated because the degradation compensation gains of respective sub-pixels is 1.

14. The data processing apparatus according to claim 9, wherein the uncompensated input image data is reduced by the maximum degradation compensation gain.

15. A data processing method of an organic light emitting diode display device, comprising:

inputting uncompensated input image data;

modulating the uncompensated input image data using a maximum degradation compensation gain to produce modulated image data;

compensating degradation of the modulated image data using a degradation compensation gain to produce degradation-compensated image data;

accumulating the degradation-compensated image data per each of sub-pixels to determine a degree of degradation of each of the sub-pixels based on the accumulated image data per each of the sub-pixels;

detecting a degradation compensation gain in accordance with the determined degradation degree;

detecting a maximum one of degradation compensation gains of respective sub-pixels;

setting a peak luminance control (PLC) gain by analyzing the uncompensated input image data;

modulating the PLC gain using the detected maximum degradation compensation gain;

detecting a peak luminance by analyzing the degradation-compensated image data; and adjusting the detected peak luminance using the modulated PLC gain, wherein the peak luminance is adjusted by modulating the uncompensated input image data and the PLC gain before the compensation of the degradation of the modulated image data.

16. The data processing method according to claim 15, wherein the maximum degradation compensation gain is detected by comparing the stored detected degradation compensation gains of the respective sub-pixels with one another.

17. The data processing method according to claim 15, further comprising:

converting the adjusted peak luminance into a maximum gamma voltage to output the maximum gamma voltage to a gamma voltage generator.

18. The data processing method according to claim 15, further comprising:

supplying the degradation-compensated image data to a data driver for display by the display device.

* * * * *